United States Patent [19]

Loring

[11] Patent Number: 4,569,136

[45] Date of Patent: Feb. 11, 1986

[54] METHOD AND APPARATUS FOR GRATIFYING EXCESSIVE ORAL NEEDS

[76] Inventor: Martha T. Loring, 411 Claire Dr. NE., Atlanta, Ga. 30307

[21] Appl. No.: 571,840

[22] Filed: Jan. 19, 1984

[51] Int. Cl.[4] ..... A24F 5/04

[52] U.S. Cl. ..... 131/273; 131/223; 604/79; 128/207.16; 128/725

[58] Field of Search ..... 604/79; 128/207.16, 128/725; 131/223, 271, 273

[56] References Cited

FOREIGN PATENT DOCUMENTS 469744 12/1928 Fed. Rep. of Germany ..... 131/223

*Primary Examiner*—Vincent Millin

*Attorney, Agent, or Firm*—Newton, Hopkins & Ormsby

[57] ABSTRACT

To satisfy the sucking need present to some degree in all humans, a sucking device having the shape of a smoking pipe has its bowl filled with a consumable liquid which the user withdraws through the stem of the device by sucking on the stem mouthpiece. An adjustable needle valve is provided on the stem to regulate the sucking power required to receive the liquid in the mouth. The bowl of the device is provided with a cover on which is mounted a diaphragm valve or other one-way opening check valve through which air enters the bowl to prevent the formation of a vacuum therein.

4 Claims, 2 Drawing Figures

METHOD AND APPARATUS FOR GRATIFYING EXCESSIVE ORAL NEEDS

BACKGROUND OF THE INVENTION

The present invention is a device to fulfill the oral sucking need which is present in all humans, but exists to an abnormal or unhealthy degree in some. Freud theorized that, in cases where suckling infants do not receive enough tenderness and love from the mother, they may turn to other sucking behavior to symbolically reach for love.

When this excessive need is carried into adulthood, some individuals turn to alcohol, some smoke or eat excessively, etc. All of these oral activities involve the use of one or more of the following: lips, tongue, cheeks, jaw and throat. The use of one or more of these five muscle systems is known to often promote relaxation, reduce stress, and cause pleasurable sensations. The utilization of the muscle systems includes both acceptable social behavior, like talking and eating, and unacceptable behavior including overeating, alcoholism and smoking.

The present invention is designed to allow the user to feel that his or her oral needs are being satisfied in a socially acceptable manner, with no overindulgence involved. The user can select a small amount of any consumable liquid and place it in the bowl or cup of the device. The user then adjusts the stem needle valve to regulate the degree of sucking necessary for withdrawal of small amounts of the liquid. The user may substitute this behavior for other, less desirable, behaviors.

The device is suitable as a gift, novelty or amusement device. Thus, it is beneficial from several different standpoints.

Other features and advantages of the invention will become apparent during the course of the following detailed description.

DETAILED DESCRIPTION

Figure 1:
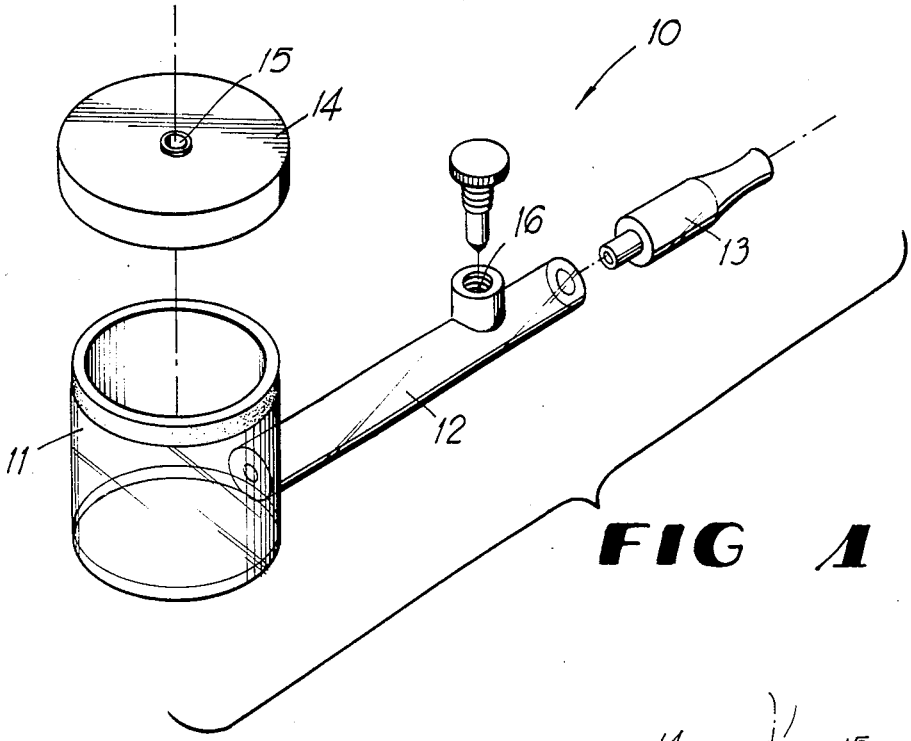
FIG. 1 is an exploded perspective view of a regulatable sucking device according to the present invention.
Figure 2:
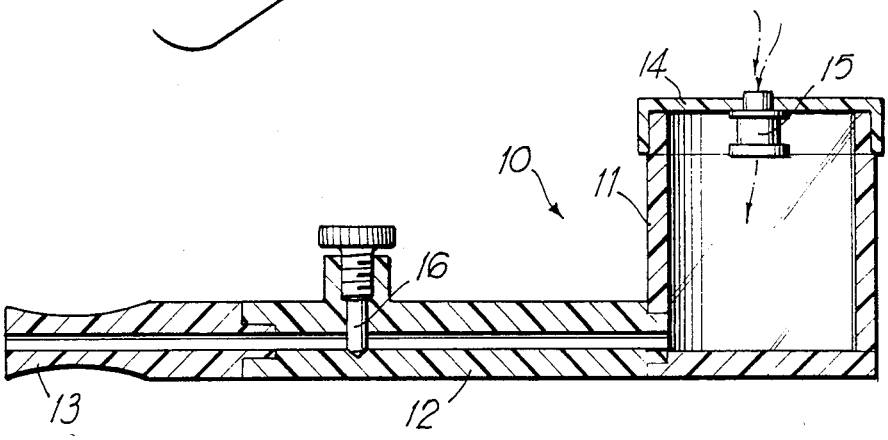
FIG. 2 is an assembled central vertical section through the sucking device.

Referring to the drawings in detail wherein like numerals designate like parts, a sucking device 10 having the shape of a smoking pipe comprises a bowl or cup 11 having a stem 12 connected therewith in a conventional manner, the stem carrying a mouthpiece 13 which is preferably removable.

A tight cover 14 for the bowl 11 is provided, and this cover is equipped with a diaphragm valve unit 15 or another oneway check valve through which ambient air enters the bowl 11 to prevent the creation of a strong vacuum therein, which would preclude withdrawal of a consumable liquid contained in the bowl, by the user of the device sucking on the mouthpiece 13.

Between the mouthpiece 13 and bowl 11, the stem 12 is equipped with a cross axis manually adjustable needle valve 16. The user of the device adjusts this needle valve to regulate the degree of sucking on the mouthpiece 13 required to withdraw the consumable liquid from the bowl 11 through the stem and into the mouth of the user. The degree of suction required for this can be widely regulated by the needle valve from a very low degree of suction up to powerful suction.

By this means, the user of the device may substitute a socially acceptable activity to satisfy his or her oral needs for other less desirable activities, such as smoking, excessive drinking and excessive eating, which contribute to poor health. In addition, the user of the device may enjoy the sucking and the fluid intake as pleasurable activities without necessarily using the device as a substitute for excessive oral needs.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A regulatable sucking device compressing a sucking unit having the approximate shape of a smoking pipe and including a bowl to contain a consumable liquid and a sucking stem connected with the bowl, an adjustable valve means on the stem operable to vary the sucking power required to draw a consumable liquid from said bowl through the stem to the mouth of a user, and a closure means on the bowl having a one-way opening check valve operable to admit ambient air to the bowl.

2. A regulatable sucking device as defined in claim 1, and said adjustable valve means comprising a cross axis adjustable needle valve on the stem.

3. A regulatable sucking device as defined in claim 2, and the stem including a mouthpiece, said needle valve being disposed between the bowl and mouthpiece and having threaded engagement with the stem.

4. A regulatable sucking device as defined in claim 1, and said closure means comprising a tight cover on said bowl.

* * * * *